US011699550B2

(12) United States Patent
Yen et al.

(10) Patent No.: US 11,699,550 B2
(45) Date of Patent: Jul. 11, 2023

(54) INDUCTOR STRUCTURE

(71) Applicant: Realtek Semiconductor Corporation, Hsinchu (TW)

(72) Inventors: Hsiao-Tsung Yen, Hsinchu (TW); Chih-Yu Tsai, Hsinchu (TW); Kai-Yi Huang, Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 264 days.

(21) Appl. No.: 17/086,637

(22) Filed: Nov. 2, 2020

(65) Prior Publication Data

US 2021/0050147 A1 Feb. 18, 2021

Related U.S. Application Data

(62) Division of application No. 15/199,956, filed on Jun. 30, 2016, now Pat. No. 10,867,746.

(30) Foreign Application Priority Data

Dec. 15, 2015 (TW) ..... 104142119

(51) Int. Cl.
*H01F 27/40* (2006.01)
*H01F 17/00* (2006.01)
(Continued)

(52) U.S. Cl.
CPC ..... *H01F 27/40* (2013.01); *H01F 17/0006* (2013.01); *H01F 27/2804* (2013.01);
(Continued)

(58) Field of Classification Search
CPC .. H01F 27/40; H01F 17/0006; H01F 27/2804; H01F 27/29; H01F 17/0013; H01F 21/12; H01F 2017/0073; H01F 2027/2814
See application file for complete search history.

(56) References Cited

U.S. PATENT DOCUMENTS 6,661,325 B2 12/2003 Suh et al.
6,775,901 B1 * 8/2004 Lee ..... H01L 23/645 366/200
(Continued)

FOREIGN PATENT DOCUMENTS

CN 101494112 A 7/2009
CN 101752066 A 6/2010
(Continued)

OTHER PUBLICATIONS

China Patent Office, "Office Action", dated Jan. 10, 2018.

*Primary Examiner* — Marlon T Fletcher
*Assistant Examiner* — Malcolm Barnes
(74) *Attorney, Agent, or Firm* — Locke Lord LLP; Tim Tingkang Xia, Esq.

(57) ABSTRACT

An inductor structure includes a first curve metal component, a second curve metal component, a connection component, and a capacitor. The first and the second curve metal components are disposed on a layer. The layer is located at a first plane, the first and the second curve metal components are located at a second plane. The connection component is coupled to the first curve metal component and the second curve metal component. A first terminal of the connection component is coupled to a first terminal of the first curve metal component. A second terminal of the connection component is coupled to a first terminal of the second curve metal component. A first terminal of the capacitor is coupled to a second terminal of the first curve metal component. A second terminal of the capacitor is coupled to a second terminal of the second curve metal component.

12 Claims, 10 Drawing Sheets

(51) Int. Cl.
*H01F 27/28* (2006.01)
*H01F 27/29* (2006.01)
*H01F 21/12* (2006.01)

(52) U.S. Cl.
CPC ..... *H01F 27/29* (2013.01); *H01F 17/0013* (2013.01); *H01F 21/12* (2013.01); *H01F 2017/0073* (2013.01); *H01F 2027/2814* (2013.01)

(56) References Cited

U.S. PATENT DOCUMENTS 7,023,315 B2 4/2006 Yeo et al.
7,501,709 B1 * 3/2009 Hool ..... H01L 24/49 257/691
8,110,932 B2 * 2/2012 Sjoestroem ..... H01L 24/49 257/784
8,183,971 B2 5/2012 Guillou et al.
10,305,196 B2 * 5/2019 Redd ..... H01Q 19/062
2005/0017352 A1 * 1/2005 Lee ..... H01L 24/05 257/728
2005/0167828 A1 * 8/2005 Yeo ..... H01L 23/645 438/455
2005/0285262 A1 * 12/2005 Knapp ..... H01L 24/48 257/E23.033
2007/0128821 A1 * 6/2007 Lee ..... H01L 23/49838 257/E23.079
2009/0188104 A1 7/2009 Ching et al.
2009/0195325 A1 * 8/2009 Menon ..... H03H 7/38 257/664
2009/0236701 A1 * 9/2009 Sun ..... H01L 24/48 257/E23.024
2010/0117737 A1 * 5/2010 Kondo ..... H03F 1/565 330/276
2011/0316657 A1 * 12/2011 Park ..... H01L 23/645 336/200
2012/0082194 A1 * 4/2012 Tam ..... H04B 5/0031 375/219
2012/0105304 A1 * 5/2012 Ma ..... H01Q 1/2283 343/906
2012/0223796 A1 * 9/2012 Huang ..... H01L 23/645 336/142
2012/0249282 A1 10/2012 Sin et al.
2013/0099974 A1 4/2013 Wang et al.
2013/0299941 A1 * 11/2013 Lee ..... H01F 17/0006 257/531
2014/0197918 A1 * 7/2014 Kang ..... H01F 27/2804 336/200
2014/0253391 A1 * 9/2014 Yen ..... H01Q 9/00 343/700 MS
2016/0064140 A1 * 3/2016 Cuoco ..... H01F 5/00 333/185
2019/0181072 A1 * 6/2019 Shojaie ..... H01L 24/48

FOREIGN PATENT DOCUMENTS

CN 102738128 A 10/2012
TW 200701272 A 1/2007
TW 201230086 A 7/2012
TW 201237895 A 9/2012

* cited by examiner

INDUCTOR STRUCTURE

RELATED APPLICATIONS

This application is a Divisional Application of U.S. application Ser. No. 15/199,956, filed Jun. 30, 2016, which claims priority to Taiwan Application Serial Number 104142119, filed Dec. 15, 2015, which is herein incorporated by reference.

BACKGROUND

Field of Invention

The present disclosure relates to a basic electronic circuit. More particularly, the present disclosure relates to an inductor structure.

Description of Related Art

In an advanced manufacturing process, designs of spiral-shaped inductors or 8-shaped inductors are limited by the area of the chip, and moreover, the cost of spiral-shaped inductors and 8-shaped inductors is high. In addition, such inductors are close to a substrate such that coupling easily occurs between the inductors and the substrate, thereby significantly affecting the quality factor of the inductors.

In view of the foregoing, problems and disadvantages are associated with existing products that require further improvement. However, those skilled in the art have yet to find a solution.

SUMMARY

In order to solve the problems mentioned above, one aspect of the present disclosure is directed to an inductor structure. The inductor structure includes a first curve metal component, a second curve metal component, a connection component, and a capacitor. The first curve metal component is disposed on a layer. The layer is located at a first plane, the first curve metal component is located at a second plane, and the first plane is perpendicular to the second plane. The second curve metal component is disposed on the layer. The second curve metal component is located at the second plane. The connection component is coupled to the first curve metal component and the second curve metal component. A first terminal of the connection component is coupled to a first terminal of the first curve metal component, and a second terminal of the connection component is coupled to a first terminal of the second curve metal component. A first terminal of the capacitor is coupled to a second terminal of the first curve metal component, and a second terminal of the capacitor is coupled to a second terminal of the second curve metal component.

In order to solve the problems mentioned above, one aspect of the present disclosure is directed to an inductor structure. The inductor structure includes a first curve metal component, a second curve metal component, and a connection component. The first curve metal component is disposed on a layer. The layer is located at a first plane, the first curve metal component is located at a second plane, and the first plane is perpendicular to the second plane. The second curve metal component is disposed on the layer. The second curve metal component is located at the second plane. The connection component is coupled to the first curve metal component and the second curve metal component. The connection component includes a first spiral-shaped inductor. A first terminal of the first curve metal component is coupled to a first terminal of the first spiral-shaped inductor, and a first terminal of the second curve metal component is coupled to a second terminal of the first spiral-shaped inductor.

In order to solve the problems mentioned above, one aspect of the present disclosure is directed to an inductor structure. The inductor structure includes a first curve metal component, a second curve metal component, a connection component, a first switch, and a second switch. The first curve metal component is disposed on a layer. The layer is located at a first plane, the first curve metal component is located at a second plane, and the first plane is perpendicular to the second plane. The second curve metal component is disposed on the layer. The second curve metal component is located at the second plane. The connection component is coupled to the first curve metal component and the second curve metal component. A first terminal of the first switch is coupled to a first terminal of the first curve metal component, and a second terminal of the first switch is coupled to a first terminal of a spiral-shaped inductor. A first terminal of the second switch is coupled to a first terminal of the second curve metal component, and a second terminal of the second switch is coupled to a second terminal of the spiral-shaped inductor. The connection component is coupled to a center-tapped terminal of the spiral-shaped inductor.

BRIEF DESCRIPTION OF THE DRAWINGS

The disclosure can be more fully understood by reading the following detailed description of the embodiment, with reference made to the accompanying drawings as follows.

DETAILED DESCRIPTION

Unless otherwise defined herein, scientific and technical terminologies employed in the present disclosure shall have the meanings that are commonly understood and used by one of ordinary skill in the art. Unless otherwise required by context, it should be understood that singular terms shall include plural forms of the same and plural terms shall include singular forms of the same.

In the following description, the terms "coupled" may be used to indicate that two or more elements are in direct physical or electrical contact with each other, or may also mean that two or more elements may be in indirect physical or electrical contact with each other. "Coupled" may still be used to indicate that two or more elements cooperate or interact with each other.

Figure 1:
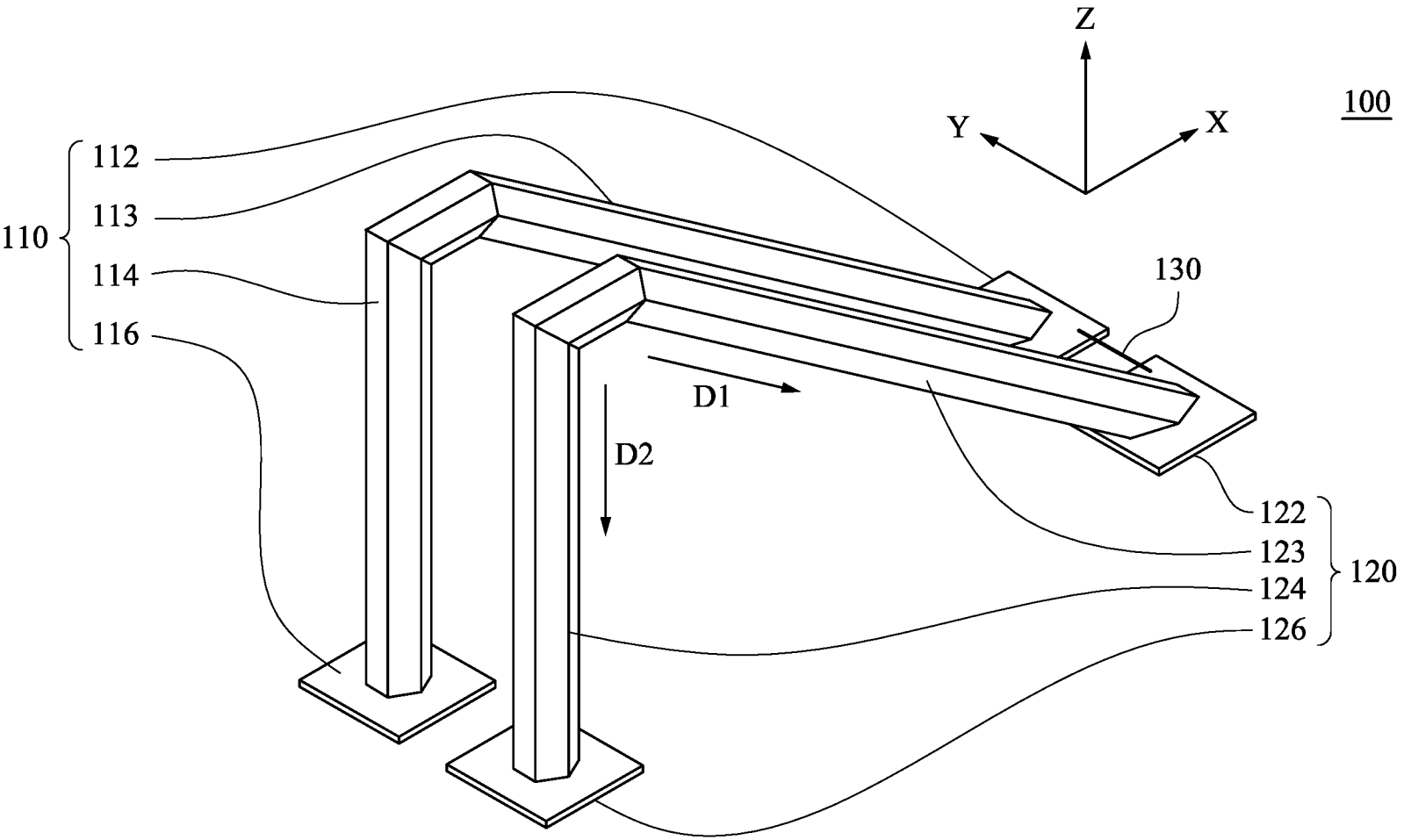
FIG. 1 is a schematic diagram of an inductor structure according to embodiments of the present disclosure.

FIG. 1 is a schematic diagram of an inductor structure according to embodiments of the present disclosure. The inductor structure 100 comprises a first curve metal component 110, a second curve metal component 120 and a connection component 130. The first curve metal component 110 is disposed on a layer (not shown in the figure). The layer is located at a first plane (e.g., an XY plane), and the layer can be a CMOS oxide layer or another similar structure. The first curve metal component 110 is located at a second plane (e.g., an XZ plane), and the first plane is perpendicular to the second plane. The second curve metal component 120 is disposed on the layer, and the second curve metal component 120 is located at the second plane. The connection component 130 is coupled to the first curve metal component 110 and the second curve metal component 120. Therefore, the connection component 130 is used to couple the curved metal components 110, 120, such that the curved metal components 110, 120 and the connection component 130 form an inductor structure. The inductor structure 100 restructures a ring-shaped inductor which is laid on the first plane (e.g., the XY plane), and then separated into the curved metal components 110, 120. The ring-shaped inductor comprising the curved metal components 110, 120 is raised from the first plane (e.g., the XY plane) to the second plane (e.g., the XZ plane). Hence, compared with spiral-shaped inductors or 8-shaped inductors, the inductor structure 100 of the present disclosure occupies a smaller area, and the quality factor (e.g., Q value) of the inductor structure 100 of the present disclosure is also higher.

In one embodiment, the first curve metal component 110 and the second curve metal component 120 comprise first strip portions 113, 123 and second strip portions 114, 124 which are coupled to each other. The first strip portions 113, 123 and the second strip portions 114, 124 are disposed in a first direction and a second direction respectively. For example, the first strip portions 113, 123 are disposed in the first direction D1, and the second strip portions 114, 124 are disposed in the second direction D2. As shown in the figure, the first direction D1 is different from the second direction D2. For example, the angle between the first direction D1 and the XY plane is about 45 degrees, and the second direction D2 is roughly perpendicular to the XY plane. In addition, the first strip portions 113, 123 are located at one side of the inductor structure 100, and the second strip portions 114, 124 are located at another side of the inductor structure 100. In one embodiment, the connection component 130 is coupled to the first strip portion 113 of the first curve metal component 110 and the first strip portion 123 of the second curve metal component 120.

Figure 2:
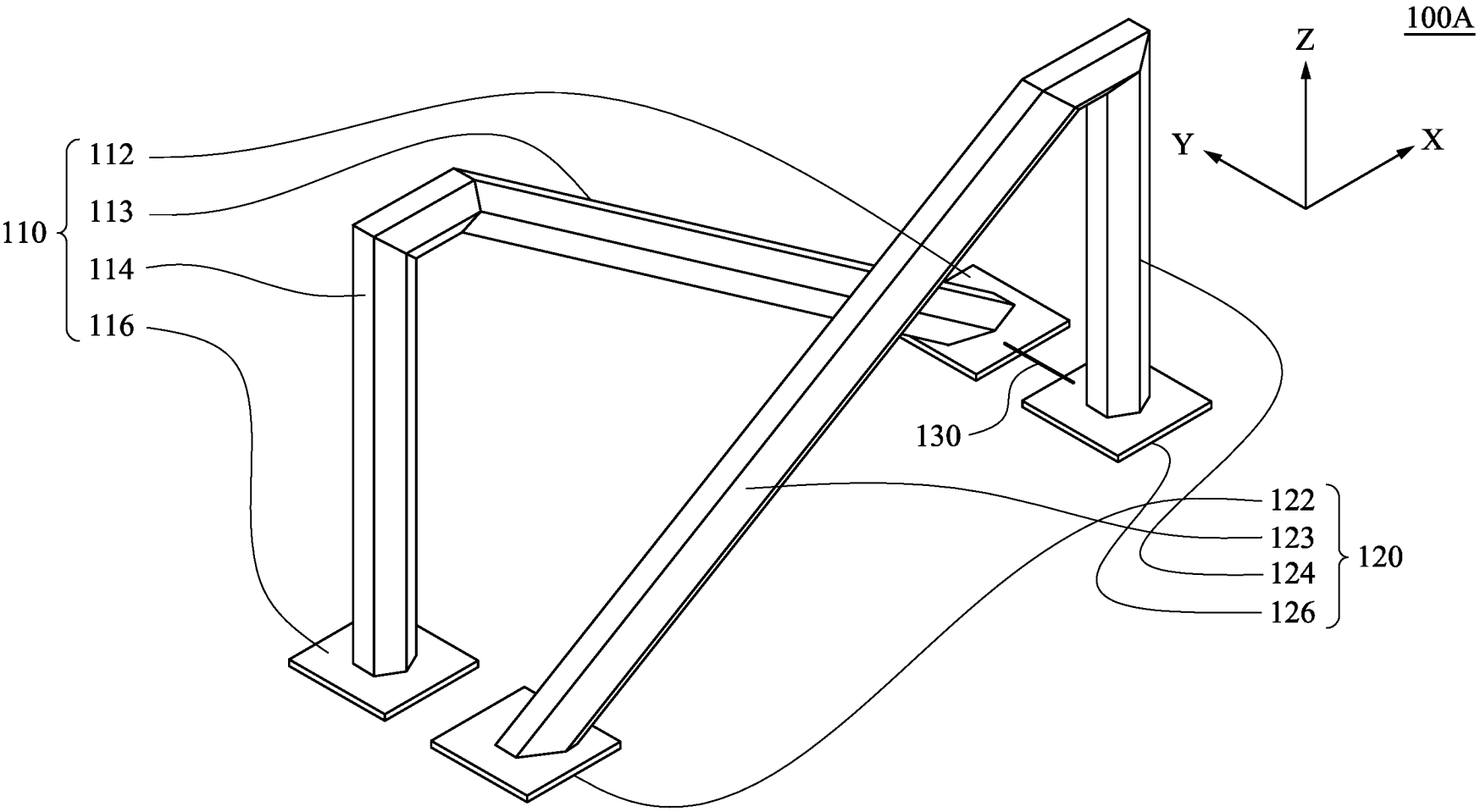
FIG. 2 is a schematic diagram of an inductor structure according to embodiments of the present disclosure.

FIG. 2 is a schematic diagram of an inductor structure according to embodiments of the present disclosure. Compared with the inductor structure 100 of FIG. 1, the disposition of the first curve metal component 110 and the second curve metal component 120 of the inductor structure 100A of FIG. 2 is different, which is described below. The first strip portion 113 of the first curve metal component 110 and the second strip portion 124 of the second curve metal component 120 are located at one side of the inductor structure 100A, and the second strip portion 114 of the first curve metal component 110 and the first strip portion 123 of the second curve metal component 120 are located at another side of the inductor structure 100A. In one embodiment, the connection component 130 is coupled to the first strip portion 113 of the first curve metal component 110 and the second strip portion 124 of the second curve metal component 120. It is noted that the basic structures of the curved metal components 110, 120 of FIG. 2 are similar to those of the curved metal components 110, 120 of FIG. 1, such that a detailed description of the basic structures in FIG. 2 is omitted herein.

Figure 3:
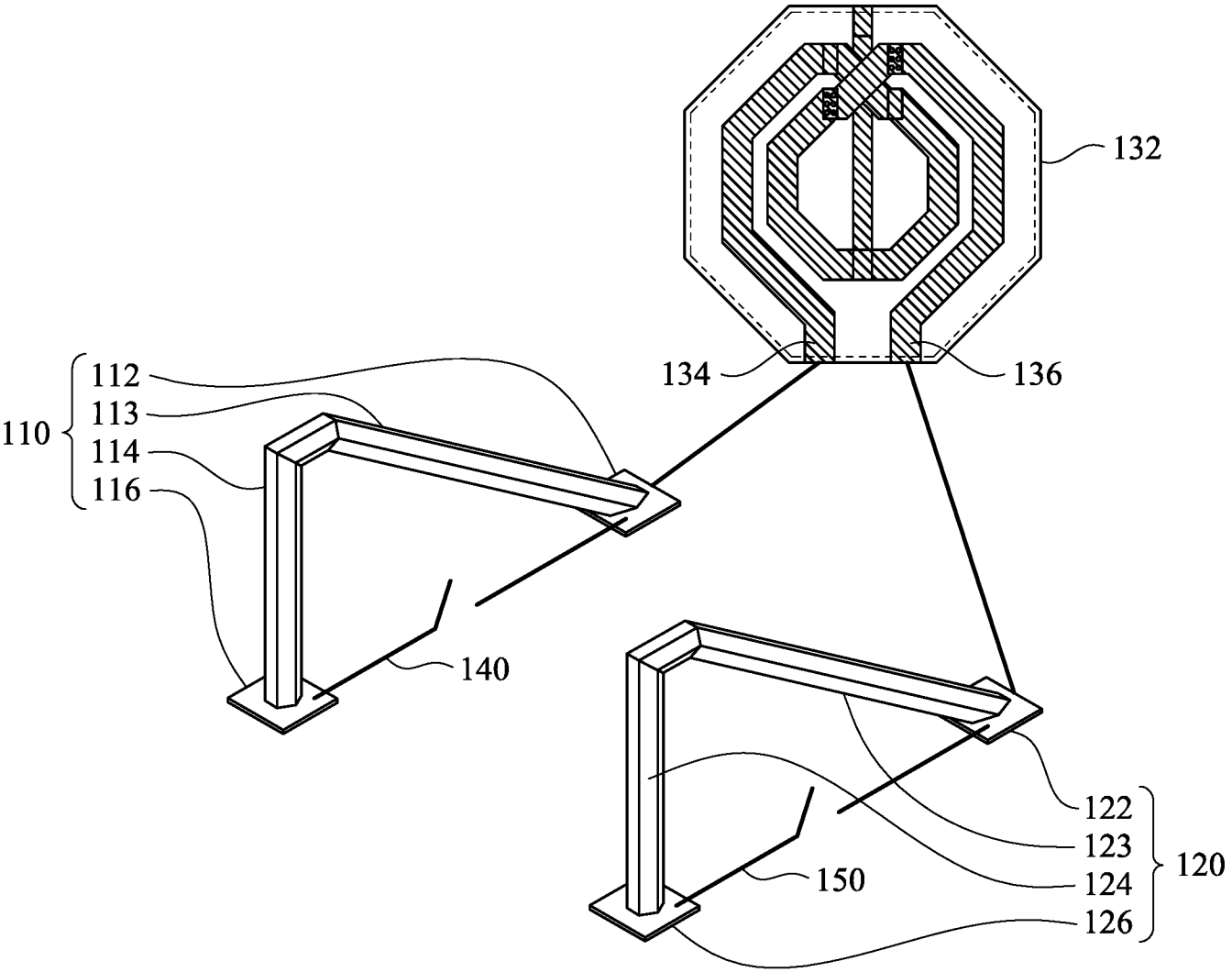
FIG. 3 is a schematic diagram of an inductor structure according to embodiments of the present disclosure.

FIG. 3 is a schematic diagram of an inductor structure according to embodiments of the present disclosure. Compared with the inductor structure 100 of FIG. 1, the connection component 130 of the inductor structure 100B in FIG. 3 comprises a spiral-shaped inductor 132. A first terminal 112 of the first curve metal component 110 is coupled to a first terminal 134 of the spiral-shaped inductor 132, and a first terminal 122 of the second curve metal component 120 is coupled to a second terminal 136 of the spiral-shaped inductor 132. In one embodiment, the inductor structure 100B further comprises a first switch 140 and a second switch 150. The first switch 140 is coupled between the first terminal 112 and a second terminal 116 of the first curve metal component 110, and the second switch 150 is coupled between the first terminal 122 and a second terminal 126 of the second curve metal component 120. Since the inductor structure 100B further comprises the switches 140, 150, the inductance of the inductor structure 100B can be adjusted by controlling the switches 140, 150, such that the application range of the inductor structure 100B can be extended. It is noted that the basic structures of the curved metal components 110, 120 of FIG. 3 are similar to those of the curved metal components 110, 120 of FIG. 1, such that a detailed description of the basic structures in FIG. 3 is omitted herein.

Figure 4:
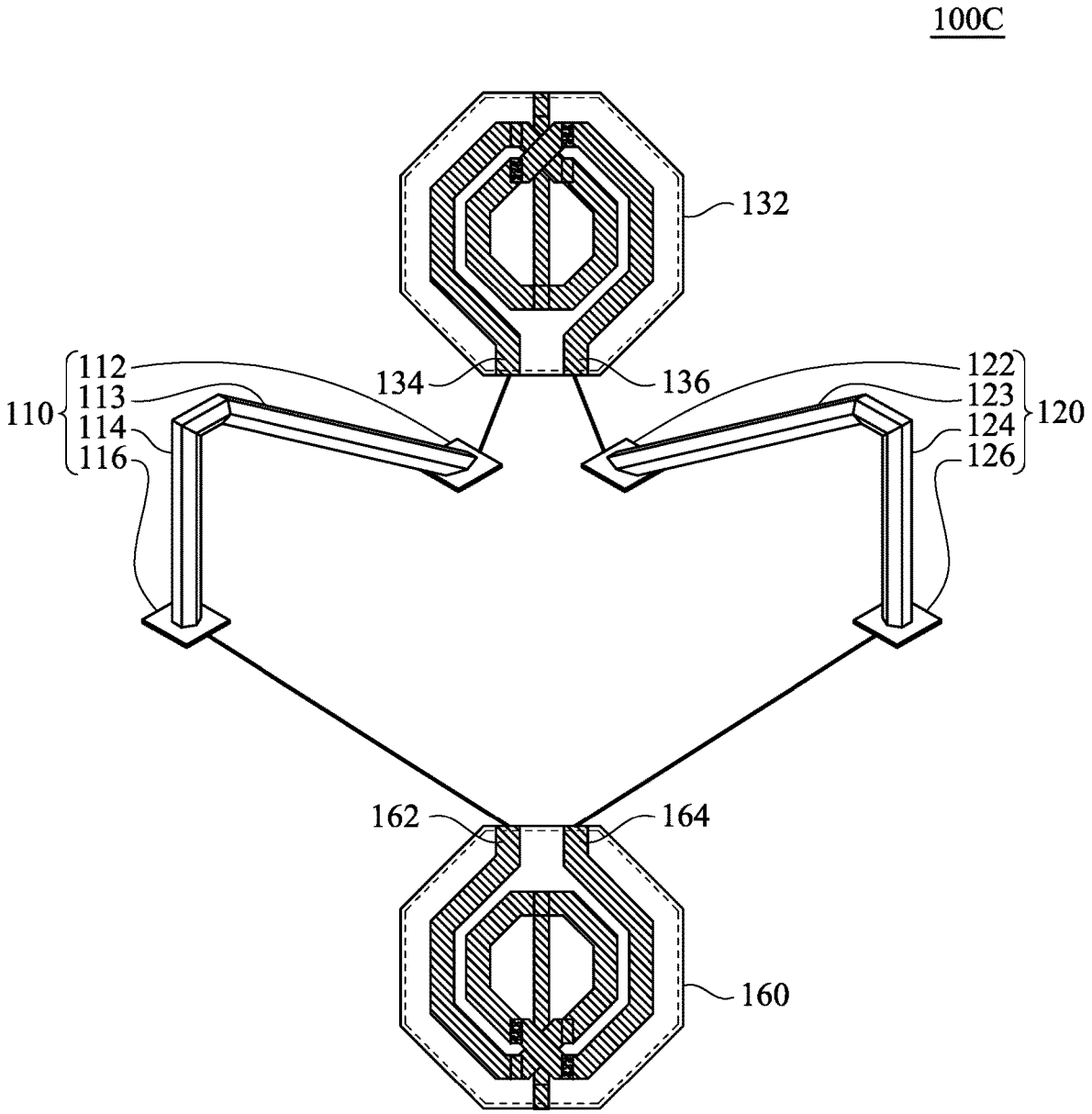
FIG. 4 is a schematic diagram of an inductor structure according to embodiments of the present disclosure.

FIG. 4 is a schematic diagram of an inductor structure according to embodiments of the present disclosure. Compared with the inductor structure 100B of FIG. 3, the inductor structure 100C of FIG. 4 further comprises a spiral-shaped inductor 160. The second terminal 116 of the first curve metal component 110 is coupled to a first terminal 162 of the spiral-shaped inductor 160, and the second terminal 126 of the second curve metal component 120 is coupled to a second terminal 164 of the spiral-shaped inductor 160. It is noted that except for the above-mentioned features, the basic structures of the inductor structure 100C of FIG. 4 are similar to those of the inductor structure 100B of FIG. 3, such that a detailed description of the basic structures in FIG. 4 is omitted herein. Moreover, the switches 140, 150 of the inductor structure 100C can be selectively disposed between two terminals of the first curve metal component 110 and/or disposed between two terminals of the second curve metal component 120 based on actual requirements.

Figure 5:
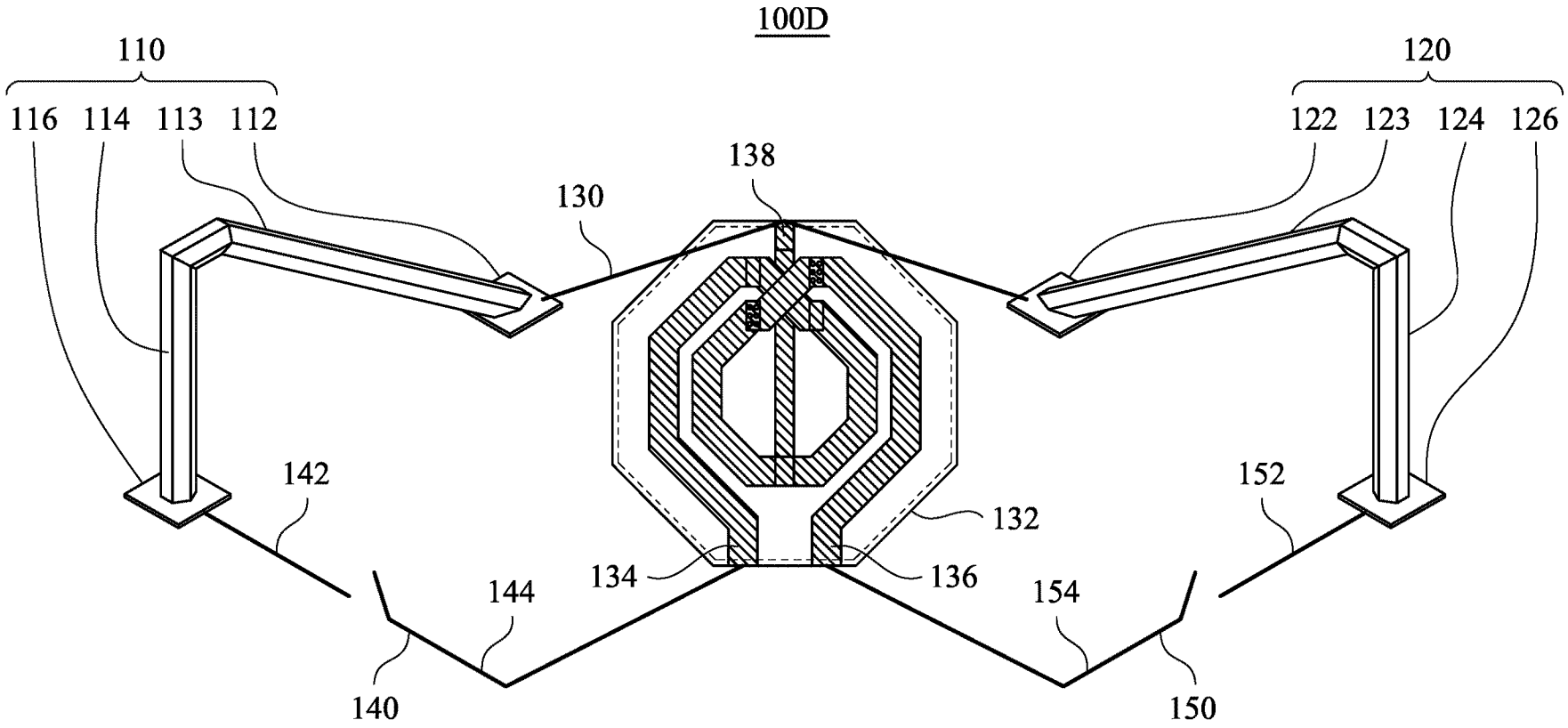
FIG. 5 is a schematic diagram of an inductor structure according to embodiments of the present disclosure.

FIG. 5 is a schematic diagram of an inductor structure according to embodiments of the present disclosure. Compared with the inductor structure 100B of FIG. 3, the disposition of the inductor structure 100D of FIG. 5 is different, which is described below. A first terminal 142 of the first switch 140 of the inductor structure 100D is coupled to one terminal 116 of the first curve metal component 110, and a second terminal 144 of the first switch 140 is coupled to the first terminal 134 of the spiral-shaped inductor 132. A first terminal 152 of the second switch 150 of the inductor structure 100D is coupled to one terminal 126 of the second curve metal component 120, and a second terminal 154 of the second switch 150 is coupled to the second terminal 136 of the spiral-shaped inductor 132. The connection component 130 is coupled to a center-tapped terminal 138 of the spiral-shaped inductor 132. Since the inductor structure 100D further comprises the switches 140, 150, the inductance of the inductor structure 100D can be adjusted by controlling the switches 140, 150, such that the application range of the inductor structure 100D can be extended. It is noted that the basic structures of the curved metal components 110, 120 of FIG. 5 are similar to those of the curved metal components 110, 120 of FIG. 1, such that a detailed description of the basic structures in FIG. 5 is omitted herein.

Figure 6:
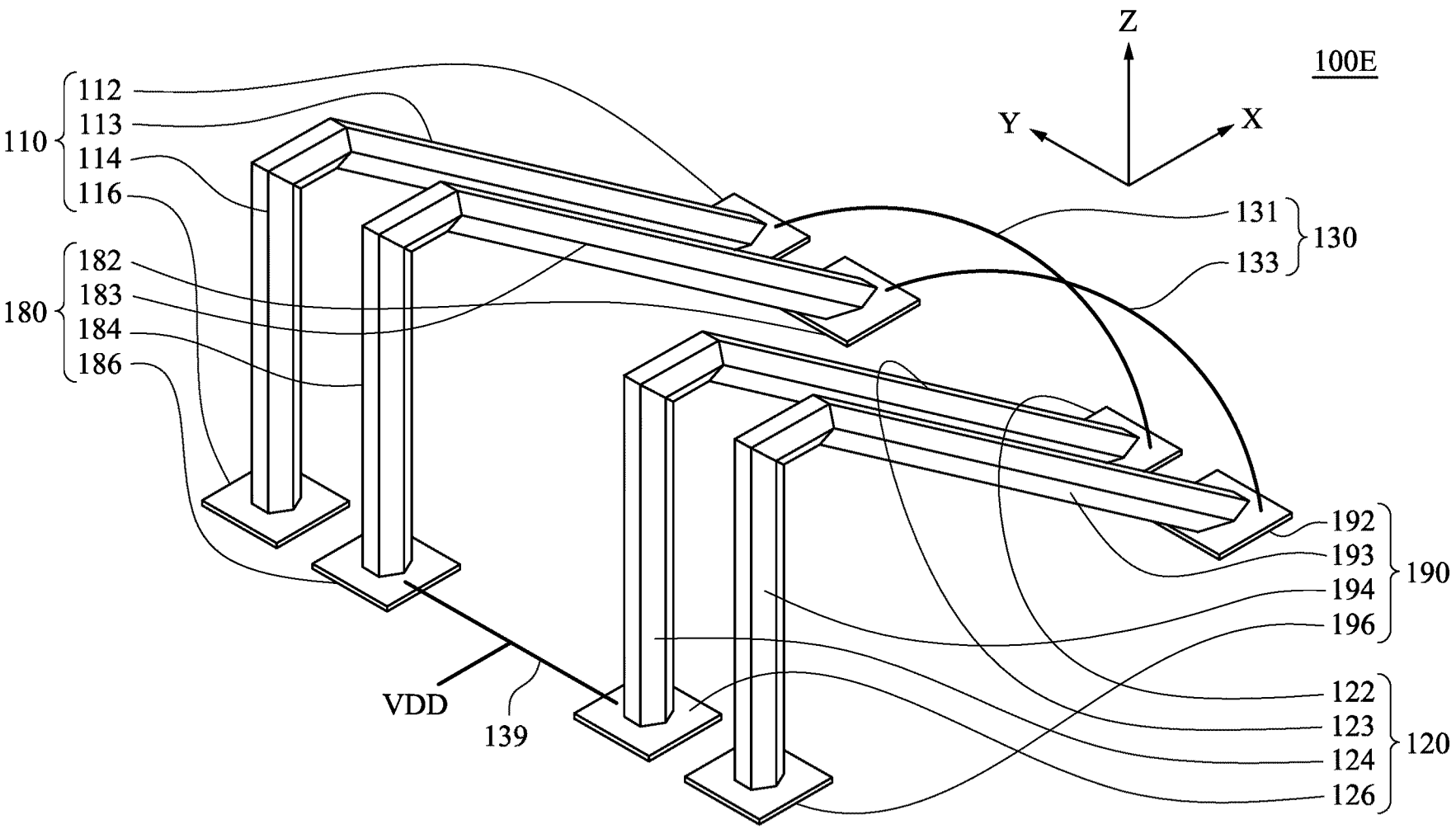
FIG. 6 is a schematic diagram of an inductor structure according to embodiments of the present disclosure.

FIG. 6 is a schematic diagram of an inductor structure according to embodiments of the present disclosure. Compared with the inductor structure 100 of FIG. 1, the inductor structure 100E further comprises a third curved metal component 180 and a fourth curved metal component 190. The structure in FIG. 6 is a normal flat inductor whose coil is curved from an XY surface to a YZ surface or an XZ surface. It is noted that the basic structures of the curved metal components 110, 120, 180, 190 of FIG. 6 are similar to those of the curved metal components 110, 120 of FIG. 1, such that a detailed description of the basic structures in FIG. 6 is omitted herein. The third curved metal component 180 is disposed on a layer (not shown in the figure). In addition, the third curved metal component 180 is located at a second plane (e.g., the XZ surface). The fourth curved metal component 190 is disposed on the layer. Moreover, the fourth curved metal component 190 is located at the second plane (e.g., the XZ surface). One terminal 192 of the fourth curved metal component 190 is coupled to one terminal 182 of the third curved metal component 180.

In one embodiment, the connection component 130 comprises a first connection unit 131 and a second connection unit 133. A first terminal of the first connection unit 131 is coupled to one terminal 112 of the first curve metal component 110, and a second terminal of the first connection unit 131 is coupled to one terminal 122 of the second curve metal component 120. A first terminal of the second connection unit 133 is coupled to one terminal 182 of the third curved metal component 180, and a second terminal of the second connection unit 133 is coupled to one terminal 192 of the fourth curved metal component 190. In another embodiment, the first curve metal component 110 is adjacent to the third curved metal component 180, and the second curve metal component 120 is adjacent to the fourth curved metal component 190. In still another embodiment, the first curve metal component 110, the third curved metal component 180, the second curve metal component 120 and the fourth curved metal component 190 are disposed sequentially. In yet another embodiment, another terminal 126 of the second curve metal component 120 is coupled to another terminal 186 of the third curved metal component 180 through a connection component 139, and the connection component 139 is configured to receive a power supply voltage VDD.

Figure 7:
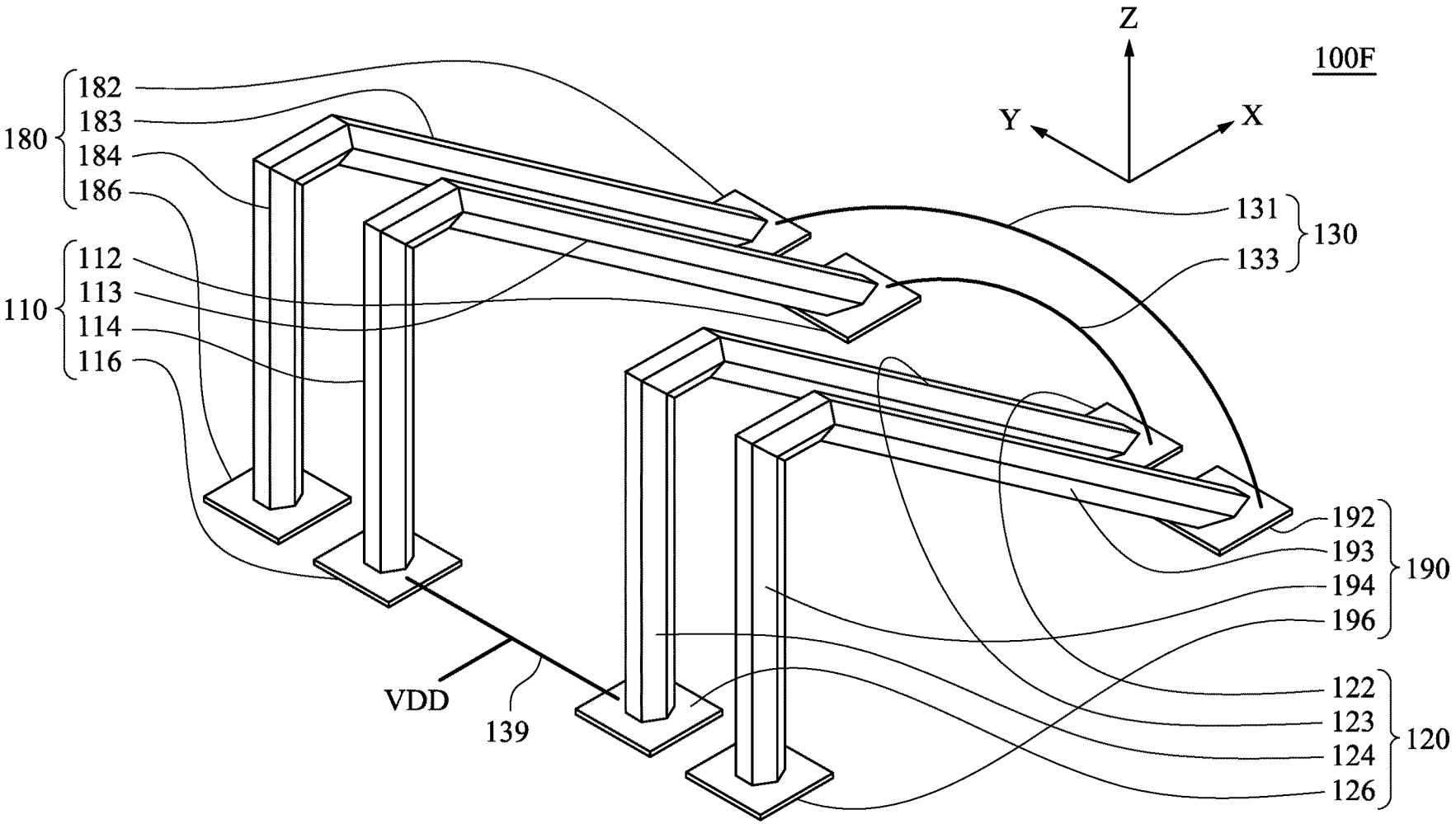
FIG. 7 is a schematic diagram of an inductor structure according to embodiments of the present disclosure.

FIG. 7 is a schematic diagram of an inductor structure according to embodiments of the present disclosure. Compared with the inductor structure 100 of FIG. 1, the inductor structure 100F further comprises a third curved metal component 180 and a fourth curved metal component 190. It is noted that the basic structures of the curved metal components 110, 120, 180, 190 of FIG. 7 are similar to those of the curved metal components 110, 120 of FIG. 1, such that a detailed description of the basic structures in FIG. 7 is omitted herein. The third curved metal component 180 is disposed on a layer (not shown in the figure). In addition, the third curved metal component 180 is located at a second plane (e.g., the XZ surface). The fourth curved metal component 190 is disposed on the layer. Moreover, the fourth curved metal component 190 is located at the second plane (e.g., the XZ surface). One terminal 192 of the fourth curved metal component 190 is coupled to one terminal 182 of the third curved metal component 180. Furthermore, the third curved metal component 180 and the fourth curved metal component 190 are disposed outwardly of the first curve metal component 110 and the second curve metal component 120.

In one embodiment, the first curve metal component 110 is adjacent to the third curved metal component 180, and the second curve metal component 120 is adjacent to the fourth curved metal component 190. In another embodiment, the third curved metal component 180, the first curve metal component 110, the second curve metal component 120 and the fourth curved metal component 190 are disposed sequentially. In yet another embodiment, one terminal 116 of the first curve metal component 110 is coupled to one terminal 126 of the second curve metal component 120 through the connection component 139, and the connection component 139 is configured to receive the power supply voltage VDD.

Figure 8:
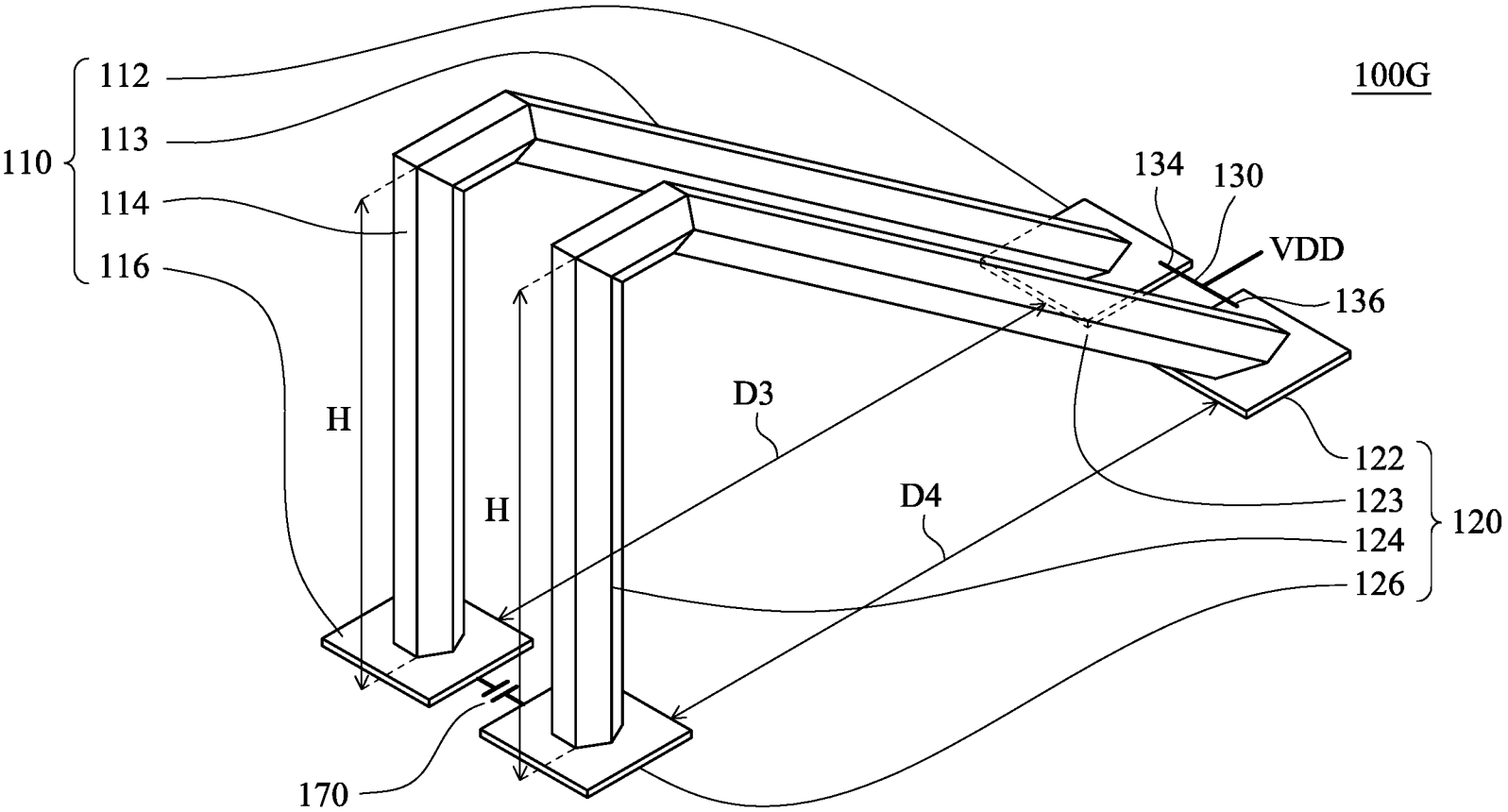
FIG. 8 is a schematic diagram of an inductor structure according to embodiments of the present disclosure.

FIG. 8 is a schematic diagram of an inductor structure according to embodiments of the present disclosure. Compared with the inductor structure 100 of FIG. 1, the inductor structure 100G in FIG. 8 further comprises a capacitor 170. The first terminal 134 of the connection component 130 is coupled to the first terminal 112 of the first curve metal component 110, and the second terminal 136 of the connection component 130 is coupled to the first terminal 122 of the second curve metal component 120. In addition, a first terminal of the capacitor 170 is coupled to the second terminal 116 of the first curve metal component 110, and a second terminal of the capacitor 170 is coupled to the second terminal 126 of the second curve metal component 120.

In one embodiment, the first curve metal component 110 comprises a first pad 112, a second pad 116 and a first strip portion (comprising structures marked 113 and 114). A first terminal of the first strip portion is coupled to the first pad 112, and a second terminal of the first strip portion is coupled to the second pad 116. The second curve metal component 120 comprises a third pad 122, a fourth pad 126 and a second strip portion (comprising structures marked 123 and 124). A first terminal of the second strip portion is coupled to the third pad 122, and a second terminal of the second strip portion is coupled to the fourth pad 126. In another embodiment, the connection component 130 is configured to receive the power supply voltage VDD.

In another embodiment, a distance D3 from the first pad 112 to the second pad 116 is about 200 um to 300 um, and a distance D4 from the third pad 122 to the fourth pad 126 is about 200 um to 300 um. Each of the first strip portion (comprising structures marked 113 and 114) and the second strip portion (comprising structures marked 123 and 124) has a height H. The height H is from the pad 116, 126 to the top of the first strip portion or the second strip portion. The height H is about 150 um to 250 um. Moreover, the diameter of each of the first strip portion and the second strip portion is about 15 um to 35 um.

Figure 9:
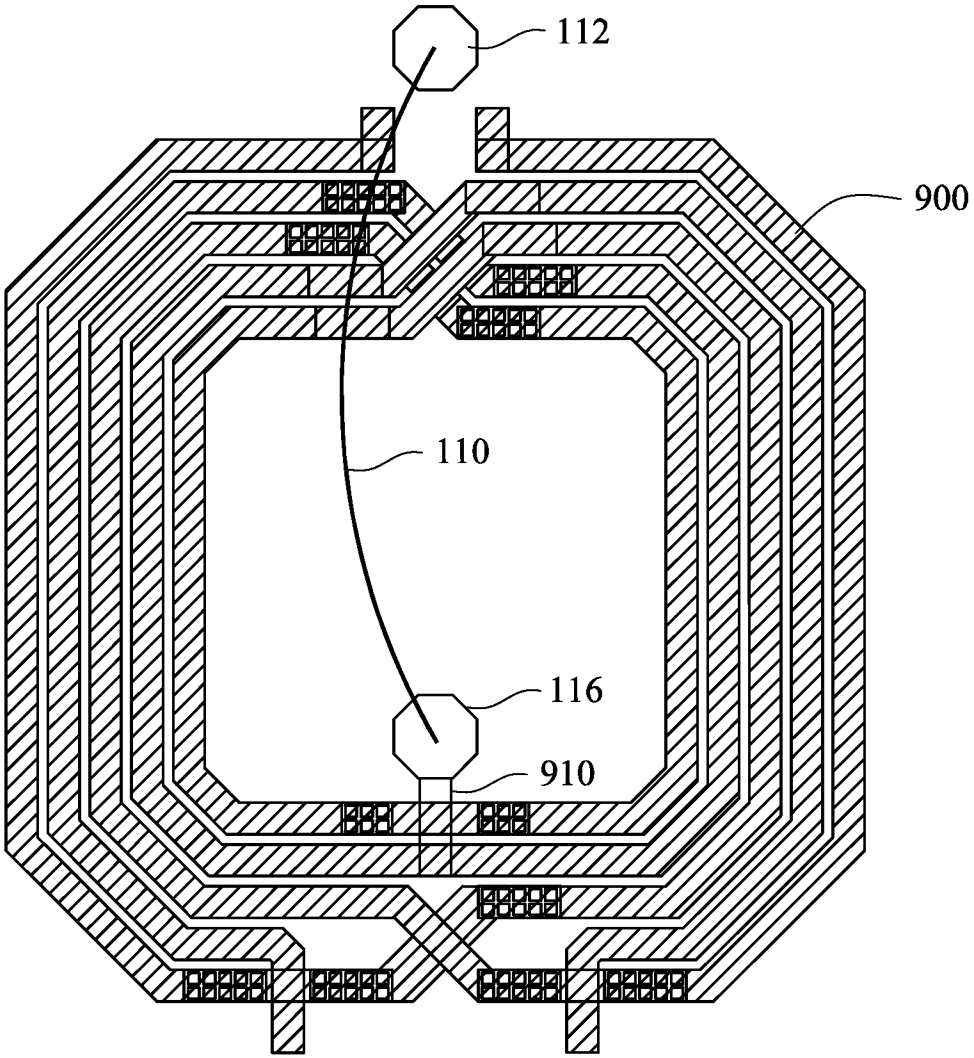
FIG. 9 is an application diagram of an inductor structure according to embodiments of the present disclosure.

FIG. 9 is an application diagram of an inductor structure according to embodiments of the present disclosure. As shown in the figure, with respect to the layout of the circuit, there is a need to connect a center tap 910 of the inductor 900 to an outer pad. The inductor structure of embodiments of the present disclosure can connect the center tap 910 to an outer pad, which is described below. Referring to FIG. 9, the inductor structure 100 comprises a curved metal component 110 and pads 112, 116. The pad 116 is coupled to the center tap 910. The curved metal component 110 can connect the center tap 910 to an outer pad (e.g., the pad 112) through the pad 116. Since the inductor structure 100 is a curve metal structure, and the curve metal structure is arched in a direction away from the center tap 910, it is distanced from the center tap 910. Hence, there is a smaller parasitic capacitance between these two elements, thereby enhancing the efficiency of the whole circuit. Moreover, since the curve metal structure of the inductor structure 100 has a better current bearing capacity, the application range of the whole circuit is increased. However, the present disclosure is not limited to the structure shown in FIG. 9. Except for the requirement that the pad 112 is located above the inductor 900, the pad 112 can be located at a right side, left side, bottom or another appropriate position of the inductor 900, depending on actual requirements.

Figure 10:
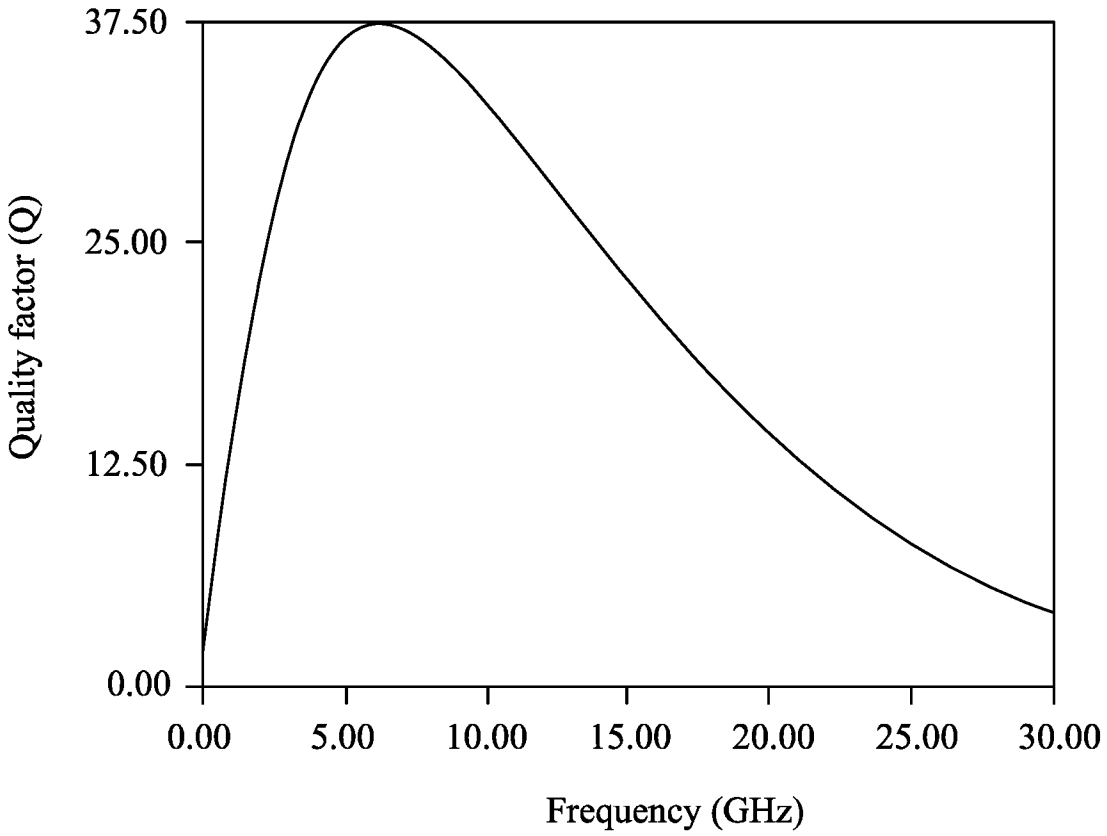
FIG. 10 is an experimental data diagram of an inductor structure according to embodiments of the present disclosure.

FIG. 10 is an experimental data diagram of an inductor structure according to embodiments of the present disclosure. This experimental data diagram is used for describing the quality factor Q of the inductor structure when the inductor operates in different frequencies. As shown in the figure, the quality factor Q of the inductor structure of the present disclosure is 37.5. Therefore, the diagram shows that the inductor structure of the present disclosure indeed can improve the quality factor and enhance the efficiency of the inductor structure.

In view of the above embodiments of the present disclosure, it is apparent that the application of the present disclosure has the advantages as follows. Embodiments of the present disclosure provide an inductor structure to improve the problems related to designs of spiral-shaped inductors or 8-shaped inductors being limited by the area of the chip, and relate also to the cost of spiral-shaped inductors and 8-shaped inductors being high. Furthermore, embodiments of the present disclosure provide an inductor structure to improve the problems related to the inductors being close to a substrate such that coupling easily occurs between the inductors and the substrate to thereby significantly affect the quality factor of the inductors.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An inductor structure, comprising:

a first curve metal component, disposed on a layer, wherein the layer is located at a first plane, the first curve metal component is located at a second plane, and the first plane is perpendicular to the second plane;

a second curve metal component, disposed on the layer, wherein the second curve metal component is located at the second plane;

a connection component, coupled to the first curve metal component and the second curve metal component; and a capacitor, wherein a first terminal of the connection component is coupled to a first terminal of the first curve metal component, and a second terminal of the connection component is coupled to a first terminal of the second curve metal component, wherein a first terminal of the capacitor is coupled to a second terminal of the first curve metal component, and a second terminal of the capacitor is coupled to a second terminal of the second curve metal component, wherein a first pad of the first curve metal component and a second pad of the first curve metal component are disposed at the same layer, wherein a distance from the first pad to the second pad is about 200 um to 300 um.

2. The inductor structure of claim 1, wherein the first curve metal component further comprises:

a first strip portion comprising:

a first terminal coupled to the first pad; and a second terminal coupled to the second pad;

wherein the second curve metal component comprises:

a third pad;

a fourth pad; and a second strip portion comprising:

a first terminal coupled to the third pad; and a second terminal coupled to the fourth pad, wherein the connection component is coupled to the first pad of the first curve metal component and the third pad of the second curve metal component.

3. The inductor structure of claim 2, wherein a distance from the third pad to the fourth pad is about 200 um to 300 um, wherein each of the first strip portion and the second strip portion comprises a height, the height is from the second pad and the fourth pad to a top of the first strip portion and the second strip portion, and the height is about 150 um to 250 um, wherein a diameter of each of the first strip portion and the second strip portion is about 15 um to 35 um.

4. The inductor structure of claim 1, wherein the connection component is configured to receive a power supply voltage.

5. An inductor structure, comprising:

a first curve metal component, disposed on a layer, wherein the layer is located at a first plane, the first curve metal component is located at a second plane, and the first plane is perpendicular to the second plane;

a second curve metal component, disposed on the layer, wherein the second curve metal component is located at the second plane; and a connection component, coupled to the first curve metal component and the second curve metal component, wherein the connection component comprises a first spiral-shaped inductor, wherein a first terminal of the first curve metal component is coupled to a first terminal of the first spiral-shaped inductor, and a first terminal of the second curve metal component is coupled to a second terminal of the first spiral-shaped inductor, wherein the first terminal of the first curve metal component and a second terminal of the first curve metal component are disposed at the same layer; and a first switch coupled between the first terminal and the second terminal of the first curve metal component.

6. The inductor structure of claim 5, further comprising:

a second switch coupled between the first terminal and a second terminal of the second curve metal component.

7. The inductor structure of claim 6, wherein an inductance of the inductor structure is adjusted by controlling the first switch and the second switch.

8. The inductor structure of claim 5, wherein the second terminal of the first curve metal component is coupled to a first terminal of a second spiral-shaped inductor, and a second terminal of the second curve metal component is coupled to a second terminal of the second spiral-shaped inductor.

9. An inductor structure, comprising:

a first curve metal component, disposed on a layer, wherein the layer is located at a first plane, the first curve metal component is located at a second plane, and the first plane is perpendicular to the second plane;

a second curve metal component, disposed on the layer, wherein the second curve metal component is located at the second plane;

a connection component, coupled to the first curve metal component, the second curve metal component, and a center-tapped terminal of a spiral-shaped inductor, wherein the center-tapped terminal of the spiral-shaped inductor is connected to the first curve metal component and the second curve metal component through the connection component; and a first switch, wherein a first terminal of the first switch is coupled to a first terminal of the first curve metal component, and a second terminal of the first switch is coupled to a first terminal of the spiral-shaped inductor.

10. The inductor structure of claim 9, further comprising:

a second switch, wherein a first terminal of the second switch is coupled to a first terminal of the second curve metal component, and a second terminal of the second switch is coupled to a second terminal of the spiral-shaped inductor.

11. The inductor structure of claim 10, wherein a second terminal of the first curve metal component and a second terminal of the second curve metal component are coupled to the connection component.

12. The inductor structure of claim 11, wherein the first curve metal component comprises:

a first pad;

a second pad; and a first strip portion comprising:

a first terminal coupled to the first pad; and a second terminal coupled to the second pad;

wherein the second curve metal component comprises:

a third pad;

a fourth pad; and a second strip portion comprising:

a first terminal coupled to the third pad; and a second terminal coupled to the fourth pad, wherein the first switch and the second switch are coupled to the first pad and the third pad respectively, wherein the connection component is coupled to the second pad, the fourth pad, and the center-tapped terminal of the spiral-shaped inductor.

* * * * *